US010017840B2

(12) United States Patent
Goto et al.

(10) Patent No.: US 10,017,840 B2
(45) Date of Patent: Jul. 10, 2018

(54) COPPER ALLOY AND METHOD FOR MANUFACTURING THE SAME

(71) Applicants: NGK Insulators, Ltd., Nagoya (JP); Tohoku University, Sendai (JP)

(72) Inventors: Takashi Goto, Sendai (JP); Hisamichi Kimura, Iwanuma (JP); Akihisa Inoue, Sendai (JP); Naokuni Muramatsu, Nagoya (JP)

(73) Assignees: NGK Insulators, Ltd., Nagoya (JP); Tohoku University, Sendai-Shi (JP)

( * ) Notice: Subject to any disclaimer, the term of this patent is extended or adjusted under 35 U.S.C. 154(b) by 452 days.

(21) Appl. No.: 14/694,038

(22) Filed: Apr. 23, 2015

(65) Prior Publication Data

US 2015/0225818 A1 Aug. 13, 2015

Related U.S. Application Data

(63) Continuation of application No. PCT/JP2013/078794, filed on Oct. 24, 2013.

(30) Foreign Application Priority Data

Nov. 1, 2012 (JP) ..... 2012-241712

(51) Int. Cl.

| | |
|---|---|
| ***C22C 9/00*** | (2006.01) |
| ***C22F 1/08*** | (2006.01) |
| ***H01B 1/02*** | (2006.01) |

(Continued)

(52) U.S. Cl.

CPC ..... *C22C 9/00* (2013.01); *B22F 3/105* (2013.01); *B22F 3/24* (2013.01); *B22F 9/08* (2013.01);

(Continued)

(58) Field of Classification Search

None

See application file for complete search history.

(56) References Cited

U.S. PATENT DOCUMENTS

2005/0011591 A1* 1/2005 Murty ..... B22F 9/082 148/400

2005/0211346 A1 9/2005 Kimura et al.

(Continued)

FOREIGN PATENT DOCUMENTS

| | | | |
|---|---|---|---|
| EP | 1 473 374 | A1 | 11/2004 |
| JP | 2000-160311 | A1 | 6/2000 |
| JP | 2005-281757 | A1 | 10/2005 |
| WO | 2005/092541 | A1 | 10/2005 |
| WO | 2011/030898 | A1 | 3/2011 |
| WO | 2011/030899 | A1 | 3/2011 |

OTHER PUBLICATIONS

Hisamichi Kimura et al., "Ultrahigh Strength and High Electrical Conductivity Characteristics of Cu—Zr Alloy Wires with Nanoscale Duplex Fibrous Structure," *Materials Transactions*, vol. 47, No. 6, Jun. 15, 2006, pp. 1595-1598.

(Continued)

*Primary Examiner* — Jessee R Roe
*Assistant Examiner* — Ngoclan T Mai
(74) *Attorney, Agent, or Firm* — Burr & Brown, PLLC

(57) ABSTRACT

A copper alloy of the present invention contains 5.00 to 8.00 atomic percent of Zr and includes Cu and a Cu—Zr compound, and two phases of the Cu and the Cu—Zr compound form a mosaic-like structure which includes no eutectic phase and in which when viewed in cross section, crystals having a size of 10 μm or less are dispersed. This copper alloy is formed by a manufacturing method including a sintering step of performing spark plasma sintering on a Cu—Zr binary system alloy powder at a temperature of 0.9 Tm ° C. or less (Tm(° C.): melting point of the alloy powder) by supply of direct-currant pulse electricity, the Cu—Zr binary system alloy powder having an average grain diameter of 30 μm or less and a hypoeutectic composition which contains 5.00 to 8.00 atomic percent of Zr. The Cu—Zr compound may include at least one of $Cu_5Zr$, $Cu_9Zr_2$, and $Cu_8Zr_3$.

10 Claims, 8 Drawing Sheets

(51) Int. Cl.

| | |
|---|---|
| ***C22C 1/04*** | (2006.01) |
| ***B22F 3/105*** | (2006.01) |
| ***B22F 3/24*** | (2006.01) |
| ***B22F 9/08*** | (2006.01) |
| ***H01B 13/00*** | (2006.01) |

(52) U.S. Cl.
CPC ..... *C22C 1/0425* (2013.01); *C22C 1/0491* (2013.01); *C22F 1/08* (2013.01); *H01B 1/026* (2013.01); *H01B 13/00* (2013.01)

(56) References Cited

U.S. PATENT DOCUMENTS

2012/0145438 A1 6/2012 Muramatsu et al.
2012/0148441 A1 6/2012 Muramatsu et al.

OTHER PUBLICATIONS

Extended European Search Report (Application No. 13850956.7) dated May 18, 2016.
International Preliminary Report on Patentability (Application No. PCT/JP2013/078794) dated May 14, 2015.
Hisamichi Kimura et al, "*Electrical and Mechanical Properties of Cu-4.5 at.% Zr Alloy Produced by Powder Metallurgy*," Journal of the JRICu, vol. 50, No. 1, 2011, pp. 75-79.
Naokuni Muramatsu et al., "*Microstructures and Mechanical and Electrical Properties of Wires Drawn from Hypoeutectic Cu—Zr Alloys Preprocessed by Spark Plasma Sintering*," Journal of Japan Institute of Copper, vol. 52, No. 1, 2013, pp. 231-235.
International Search Report and Written Opinion (Application No. PCT/JP2013/078794) dated Jan. 14, 2014.

* cited by examiner

Cross-Sectional Image of φ 1 mm Drawn Wire of Cu-1at%Zr Alloy

Cross-Sectional Image of φ 1 mm Drawn Wire of Cu-3at%Zr Alloy

Cross-Sectional Image of φ 1 mm Drawn Wire of Cu-5at%Zr Alloy

COPPER ALLOY AND METHOD FOR MANUFACTURING THE SAME

BACKGROUND OF THE INVENTION

1. Field of the Invention

The present invention relates to a copper alloy and a method for manufacturing the same.

2. Description of Related Art

Heretofore, as a copper alloy used for wires, a Cu—Zr-based alloy has been known. For example, according to Patent Literature 1, a copper alloy wire having improved electrical conductivity and tensile strength has been proposed. This copper alloy wire is obtained in such a way that after a solution treatment is performed on an alloy containing 0.01 to 0.50 percent by weight of Zr, wire drawing thereof is performed to obtain a wire having a final wire diameter, and a predetermined aging treatment is then performed. In this copper alloy wire, $Cu_3Zr$ is precipitated in a Cu mother phase so that the strength is increased to 730 MPa. In addition, according to Patent Literature 2, the present inventors have proposed that in order to increase the strength to 1,250 MPa, a copper alloy is formed which contains 0.05 to 8.0 atomic percent of Zr, which includes a Cu mother phase and a eutectic phase of Cu and a Cu—Zr compound, each phase having a layered structure, and which has a biphasic structure in which adjacent crystal grains of the Cu mother phase are intermittently connected to each other. In addition, for example, there have also been proposed a copper alloy wire which includes a copper mother phase and a composite phase formed of a copper-zirconium compound phase and a copper phase and which forms a mother phase-composite phase fibrous structure from the copper mother phase and the composite phase (for example, see Patent Literature 3) and copper alloy foil which includes a copper mother phase and a composite phase formed of a copper-zirconium compound phase and a copper phase and which forms a mother phase-composite phase layered structure from the copper mother phase and the composite phase (for example, see Patent Literature 4). Since the copper alloy described above is formed to have a dense fibrous or a dense layered dual structure, the tensile strength thereof can be increased.

PTL 1: JP 2000-160311 A
PTL 2: JP 2005-281757 A
PTL 3: WO2011/030898
PTL 4: WO2011/030899

SUMMARY OF THE INVENTION

It has been known that when the content of Zr of a Cu—Zr-based copper alloy is increased, the flexibility of the metal is decreased, and the workability thereof is degraded. For example, according to the copper alloy disclosed in the above Patent Literature 1, although the electrical conductivity and the tensile strength can foe improved by an aging treatment, the increase in Zr content has not been investigated.

The present invention, was made to overcome the problem described above, and a primary object of the present invention is to provide a copper alloy having not only an increased electrical conductive property but also an increased mechanical strength even at a high Zr content.

Through intensive research to achieve the above object, the present inventors found that when a copper alloy containing Zr in a range of 5.0 to 3.0 atomic percent is powdered and is then processed by spark plasma sintering, in a copper alloy having a high Zr content, such as 5.0 atomic percent, besides the increase in electrical conductivity, the mechanical strength can also be increased. As a result, the present invention was made.

That is, a copper alloy of the present invention contains 5.00 to 8.00 atomic percent of Zr and includes Cu and a Cu—Zr compound, and in addition, two phases of the Cu and the Cu—Zr compound form a mosaic-like structure which includes no eutectic phase and in which crystals having a size of 10 μm or less are dispersed when viewed in cross section.

A method for manufacturing a copper alloy of the present invention is a method for manufacturing a copper alloy including Cu and a Cu—Zr compound, and the method comprises a sintering step of performing spark plasma sintering on a Cu—Zr binary system alloy powder at a temperature of 0.9 Tm° C. or less (Tm(° C.): melting point of the above alloy powder) by supply of direct-current pulse electricity, the Cu—Zr binary system alloy powder having an average grain diameter of 30 μm or less and a hypoeutectic composition which contains 5.00 to 8.00 atomic percent of Zr.

According to this copper alloy and the manufacturing method thereof, in a copper alloy having a high Zr content, besides the increase in electrical conductivity, the mechanical strength can also be increased. The reason the effect as described above can be obtained is inferred as follows. For example, since a Cu—Zr binary system alloy powder is processed by spark plasma sintering (SPS), a biphasic structure including a network-like Cu phase and a mosaic-like Cu—Zr compound phase dispersed therein is formed. It is inferred that by the presence of the network-like Cu phase, a higher electrical conductivity can be obtained. In addition, it is also inferred that by the presence of a Cu—Zr compound having high Young's modulus and hardness, a higher mechanical strength can be obtained. Furthermore, by the presence of the network-like Cu phase, the copper alloy can be elongated by deformation in subsequent wire drawing or rolling; hence, it is also inferred that even by a copper alloy having a high Zr content, higher workability can be obtained.

DETAILED DESCRIPTION OF THE INVENTION

A copper alloy of the present invention contains 5.00 to 8.00 atomic percent of Zirconium (Zr) and includes copper (Cu) and a Cu—Zr compound, and two phases of the Cu and the Cu—Zr compound form a mosaic-like structure which includes no eutectic phase and in which crystals having a size of 10 μm or less are dispersed when viewed in cross section.

The Cu phase is a phase containing Cu and, for example, may be a phase containing α-Cu. This Cu phase forms a mosaic-like structure by the crystals thereof together with the Cu—Zr compound phase. By this Cu phase, the electrical conductivity can be increased, and furthermore, the workability can also be improved. This Cu phase includes no eutectic phase. In this embodiment, the eutectic phase is defined as, for example, a phase including Cu and a Cu—Zr compound. This Cu phase is formed of crystals having a size of 10 μm or less when the copper alloy is viewed in cross section.

Figure 1:
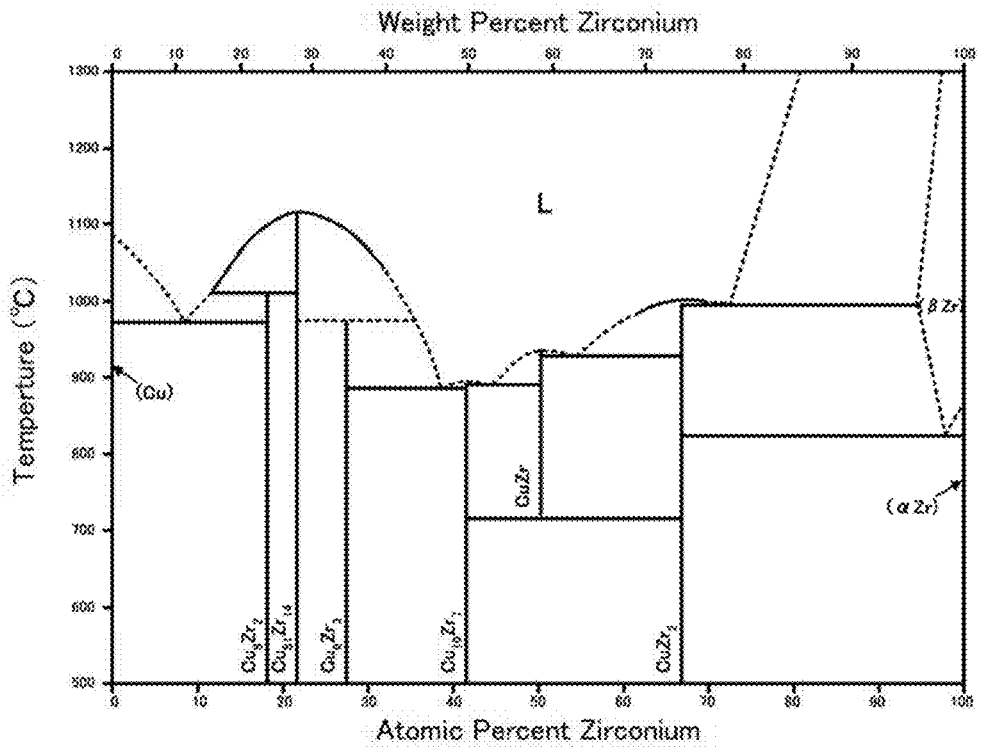
FIG. 1 shows a Cu—Zr binary system phase diagram.

The copper alloy of the present invention includes a Cu—Zr compound phase. FIG. 1 shows a Cu—Zr binary system phase diagram in which the horizontal axis represents the Zr content and the vertical axis represents the temperature (adapted from D. Arias and J. P. Abriata, Bull, Alloy phase diagram 11 (1990), 452-459). As the Cu—Zr compound phase, various phases shown in the Cu—Zr binary system phase diagram of FIG. 1 may be mentioned. In addition, a $Cu_5Zr$ phase, which is a compound having a composition very similar to that of a $Cu_9Zr_2$ phase, may also foe mentioned although not shown in the Cu—Zr binary system phase diagram. For example, the Cu—Zr compound phase may include at least one of a $Cu_5Zr$ phase, a $Cu_9Zr_2$ phase, and a $Cu_8Zr_3$ phase. Among those mentioned above, the $Cu_5Zr$ phase and the $Cu_9Zr_2$ phase are preferable. The $Cu_5Zr$ phase and the $Cu_9Zr_2$ phase each can be expected to have a high strength. For the identification of the phase, for example, after structure observation is performed by a scanning transmission electron microscope (STEM), a composition analysis using an energy dispersive X-ray (EDX) analytical apparatus may be performed on the viewing field used for the structure observation, or a structural analysis may be performed by a nano-electron beam diffraction (NBD) method. The Cu—Zr compound phase may be a monophase or a phase containing at least two types of Cu—Zr compounds. For example, the Cu—Zr compound phase may be a $Cu_9Zr_2$ monophase, a $Cu_5Zr$ monophase, or a $Cu_8Zr_3$ monophase or may contain a $Cu_5Zr$ phase as a main phase and at least one another Cu—Zr compound ($Cu_9Zr_2$ and/or $Cu_8Zr_3$) as a subphase or a $Cu_9Zr_2$ phase as a main phase and at least one another Cu—Zr compound ($Cu_5Zr$ and/or $Cu_8Zr_3$) as a subphase. In the case described above, the main phase indicates among the Cu—Zr compound phases, a phase having a largest presence ratio (volume ratio), and the subphase indicates among the Cu—Zr compound phases, a phase other than the main phase. This Cu—Zr compound phase is formed of crystals having a size of 10 μm or less when the copper alloy is viewed in cross section. Since this Cu—Zr compound phase has, for example, high Young's modulus and hardness, by the presence of this Cu—Zr compound phase, the mechanical strength of the copper alloy can be further increased.

In the copper alloy of the present invention, this mosaic-like structure may be a uniform and dense biphasic structure. The Cu phase and the Cu—Zr compound phase may include no eutectic phase and furthermore, may also include neither dendrites nor the structure formed by the growth thereof.

The copper alloy of the present invention contains 5.00 to 8.00 atomic percent of Zr in the alloy composition. Although the balance thereof may contain elements other than copper, the alloy is preferably formed from copper and inevitable impurities, and the amount of the inevitable impurities is preferably decreased as small as possible. That is, the copper alloy of the present invention is preferably a Cu—Zr binary system alloy, and x in the composition formula of $Cu_{100-x}Zr_x$ preferably represents 5.00 to 8.00. The reason for this is that when Zr is in the range described above, as shown in the binary system phase diagram of FIG. 1, a $Cu_9Zr_2$ phase and/or a $Cu_5Zr$ phase very similar thereto can be obtained. Among those mentioned above, Zr is contained preferably in an amount of 5.50 atomic percent or more and more preferably in an amount of 6.00 atomic percent or more. When 5.00 atomic percent or more of Zr is contained, in general, the workability is unfavorably degraded; however, since having a mosaic-like structure, the copper alloy of the present invention may have preferable workability.

The copper alloy of the present invention may be formed by performing spark plasma sintering (SPS) on a Cu—Zr binary system alloy powder having a hypoeutectic composition. The hypoeutectic composition may be a composition containing, for example, 5.00 to 8.00 atomic percent of Zr and Cu as the balance. This copper alloy may contain inevitable components (such as a trace of oxygen). Although the spark plasma sintering will be described later in detail, direct-current pulse electricity may be supplied at a temperature of 0.9 Tm° C. or less (Tm(° C.): melting point of the alloy powder). Accordingly, a mosaic-like structure formed from a Cu phase and a Cu—Zr compound phase is likely to be obtained.

The copper alloy of the present invention may have a mosaic-like structure elongated in a wire drawing direction by performing spark plasma sintering on a Cu—Zr binary system alloy powder, followed by wire drawing. A copper alloy having a mosaic-like structure formed from a Cu phase and a Cu—Zr compound phase is easy to be processed by wire drawing. In particular, although a copper alloy containing 5.00 atomic percent or more of Zr has inferior workability, the copper alloy of the present invention can be processed by wire drawing. The wire diameter of a copper alloy wire obtained by wire drawing is preferably 1.0 mm or less, more preferably 0.10 mm or less, and further preferably 0.010 mm or less. It is significant to apply the present invention to a wire having an extremely small wire diameter as described above. In addition, in consideration of easy processing, the wire diameter is preferably 0.003 mm or more.

Alternatively, the copper alloy of the present invention may have a mosaic-like structure flattened in a rolling direction by performing spark plasma sintering on a Cu—Zr binary system alloy powder, followed by rolling. A copper alloy having a mosaic-like structure formed from a Cu phase and a Cu—Zr compound phase is easy to be processed by rolling. In particular, although a copper alloy containing 5.00 atomic percent or more of Zr has inferior workability, the copper alloy of the present invention can be processed by rolling. The thickness of copper alloy foil obtained by rolling is preferably 1.0 mm or less, more preferably 0.10 mm or less, and further preferably 0.010 mm or less. It is significant to apply the present invention to foil having an extremely small thickness as described above. In addition, in consideration of easy processing, the foil thickness is preferably 0.003 mm or more.

The copper alloy of the present invention may be an alloy having a tensile strength of 200 MPa or more. In addition, the copper alloy of the present invention may be an alloy having an electrical conductivity of 20% IACS or more. In this embodiment, the tensile strength represents a value measured in accordance with JIS-Z2201. In addition, the electrical conductivity is obtained in such a way that after the volume resistance of a copper alloy is measured in accordance with JIS-H0505, the ratio thereof to the resistance value (1.7241 μΩ·cm) of annealed pure copper is calculated for conversion into the electrical conductivity (% IACS). When the copper alloy of the present invention is further processed by wire drawing or rolling, the tensile strength thereof can be further increased to 400 MPa or more. For example, when the rate (atomic percent) of zirconium is increased, a higher tensile strength can be obtained. In addition, when wire drawing or rolling is performed, the electrical conductivity can be further increased to 40% IACS or more. In general, although the tensile strength and/or the electrical conductivity may be decreased by wire drawing or rolling, in a copper alloy in which a Cu phase and a Cu—Zr compound phase form a mosaic-like structure without including an eutectic phase, by this structure, the tensile strength and the electrical conductivity can be increased.

Next, a method for manufacturing a copper alloy of the present invention will be described. The method for manufacturing a copper alloy of the present invention may comprise (1) a powdering step of forming a Cu—Zr binary system alloy powder, (2) a sintering step of performing spark plasma sintering on the Cu—Zr binary system alloy powder, and (3) a processing step of performing wire drawing or rolling on a spark plasma sintered copper alloy. Hereinafter, the individual steps will be described. In addition, in the present invention, the powdering step may be omitted by preparing an alloy powder in advance, and/or the processing step may be omitted by separately performing the processing step.

(1) Powdering Step

In this step, a Cu—Zr binary system alloy powder is formed from a Cu—Zr binary system alloy having a hypoeutectic composition. In this step, although a powdering method is not particularly limited, for example, an alloy powder is preferably formed from a Cu—Zr binary system alloy having a hypoeutectic composition by a high-pressure gas atomizing method. In this step, the average grain diameter of the alloy powder is preferably 30 μm or less. This average grain diameter is a D50 grain diameter measured by using a laser diffraction type grain size distribution measurement apparatus. As long as a copper alloy containing Zr in a range of 5.0 to 8.0 atomic percent is formed, the raw material thereof is not particularly limited, and either an alloy or pure metals may be used, among those mentioned above, a copper alloy containing Zr in a range of 5.0 to 8.0 atomic percent is preferably used in the powdering step. In addition, when a copper alloy containing 5.5 atomic percent or more of Zr or preferably 6.0 atomic percent or more of Zr, at which the workability thereof is further degraded, is used, it is significant to apply the present invention to this copper alloy. This raw material preferably contains no elements other than Cu and Zr. In addition, a copper alloy used as the raw material preferably has no mosaic-like structure as described above. The alloy powder obtained in this step may include dendrites terminated during solidification by quenching. Such dendrites may disappear in a subsequent sintering step in some cases.

(2) Sintering Step

In this step, a spark plasma sintering treatment is performed by supplying direct-current pulse electricity to a Cu—Zr binary system alloy powder having an average grain diameter of 30 μm or less and a hypoeutectic composition which contains 5.00 to 8.00 atomic percent of Zr so as to set the temperature thereof to 0.9 Tm° C. or less (Tm(° C.): melting point of alloy powder). In this step, the direct-current pulse may be set, for example, in a range of 1.0 to 5 kA and more preferably in a range of 3 to 4 kA. The sintering temperature is set to a temperature of 0.9 Tm° C. or less and may be set, for example, to 900° C. or less. In addition, the lower limit of the sintering temperature is set to a temperature at which spark plasma sintering can be performed, and although appropriately determined in consideration of the raw material composition, the grain size, and the direct-current pulse conditions, for example, the lower limit may be set to 600° C. or more. Although appropriately determined, for example, the holding time at a maximum temperature may be set to 30 minutes or less and more preferably 15 minutes or less. During the spark plasma sintering, the pressure is preferably applied to an alloy powder, and for example, a pressure of 10 MPa or more is more preferable, and a pressure of 30 MPa or more is further preferable. Accordingly, a dense copper alloy can be obtained. As a pressure application method, for example, a method may be used in which a Cu—Zr binary system alloy powder is received in a graphite-made die and is then pressed by a graphite-made bar.

(3) Processing Step

In this step, wire drawing or rolling is performed on the spark plasma sintered copper alloy. First, the case of the wire drawing will be described. In the wire drawing step, when a wire drawing degree η is defined by $A_0/A$ ($A_0$: cross-sectional area before drawing, A: cross-sectional area after drawing), the wire drawing may be performed at a wire drawing degree η of 3.0 or more. This wire drawing degree η is more preferably 4.6 or more and may be set to 10.0 or more. In addition, the wire drawing degree η is preferably 15.0 or less. In this step, cold wire drawing may be performed. In this case, the cold wire drawing is drawing performed without heating and indicates wire drawing performed at an ordinary temperature. By the cold wire drawing, re-crystallization can be suppressed. Alternatively, in the middle of forming a drawn wire from the spark plasma sintered copper alloy, annealing may also be performed. The temperature of the annealing may be set, for example, to 650° C. or less. Although a wire drawing method is not particularly limited, for example, hole die drawing or roller die drawing may be performed, and a method is more preferable in which shear sliding deformation is generated in a subject material by applying a shearing force thereto in a direction parallel to the axis. The shear sliding deformation may be obtained, for example, by simple shear deformation generated when the material is drawn through a die while receiving a friction at the surface in contact with the die. In this wire drawing step, wire drawing may be performed using a plurality of dies having different sizes. The hole of the wire drawing die is not limited to a circle, and a square wire-forming die, a distinct shape-forming die, a tube-forming die, and the like may be used. In this wire drawing step, wire drawing is performed so that the wire diameter is preferably 1.0 mm or less, more preferably 0.10 mm or less, and further preferably 0.010 mm or less. It is significant to apply the present invention to a wire having such an extremely small diameter. In addition, in consideration of easy processing, the wire diameter is preferably 0.003 mm or more.

Next, the case of the rolling will be described. In this step, a treatment to obtain copper alloy foil is performed by a rolling treatment on the spark plasma sintered copper alloy. This rolling treatment is preferably performed at room temperature to 500° C., and cold rolling may also be performed. Alternatively, annealing may be performed in the middle of processing the spark plasma sintered copper alloy into copper alloy foil. The temperature of the annealing may foe set, for example, to 650° C. or less. Although an annealing method is not particularly limited, a rolling method using at least one pair of rollers arranged in a vertical direction may be used. For example, compression rolling and shear rolling may be mentioned, and those types of rolling may be used alone or in combination. In this case, the compression rolling indicates rolling which aims to generate compression deformation by applying a compression force to an object to be rolled. In addition, the shear rolling indicates rolling which aims to generate shear deformation by applying a shearing force to an object to be rolled. As for the processing rate, for example, a total reduction rate may be set to 70% or more. In this case, the processing rate (%) is a value obtained by calculation of ((plate thickness before rolling-foil thickness after rolling)×100)/(plate thickness before rolling). Although, not particularly limited, the rolling rate is preferably 1 to 100 m/min and more preferably 5 to 20 m/min. When the rolling rate is 5 m/min or more, the rolling can be efficiently performed, and when the rolling rate is 20 m/min or less, for example, breakage during rolling can be further suppressed. In this rolling treatment, the thickness of the foil obtained by rolling is preferably 1.0 mm or less, more preferably 0.10 mm or less, and further preferably 0.010 mm or less. It is significant to apply the present invention to foil having such an extremely small thickness. In addition, in consideration of easy processing, the foil thickness is preferably 0.003 mm or more.

According to the copper alloy and the manufacturing method thereof of the embodiment described above in detail, the workability can be further improved. Although the reason the effect as described above can be obtained has not been clearly understood, the following is inferred. For example, by spark plasma sintering of a Cu—Zr binary system alloy powder, a biphasic structure is formed from a network-like Cu phase and a mosaic-like Cu—Zr compound phase dispersed therein. It is inferred that by the presence of the network-like Cu phase, the copper alloy is elongated by deformation in subsequent wire drawing or rolling; hence, even in a region in which the content of Zr is high, higher workability can be obtained. In addition, it is also inferred that by the presence of this network-like Cu phase, a higher electrical conductivity can be obtained. Furthermore, it is also inferred that by the presence of the Cu—Zr compound phases, a higher mechanical strength can be obtained.

In general, the reason an alloy is processed by spark plasma sintering is that this alloy cannot be processed by any other methods than the spark plasma sintering, and hence, subsequent wire drawing or rolling to be performed on the above alloy has not been taken into consideration from the beginning. However, in the present invention, by a revolutionary idea of using a mosaic-like structure generated by spark plasma sintering, the workability of a copper alloy having a high Zr content can be improved.

In addition, it is to be naturally understood that the present invention is not limited at all to the above embodiment and may be performed in various modes without departing from the technical scope of the present invention.

EXAMPLES

Hereinafter, preferable examples of the present invention will be described. In addition, Experimental Examples 3 and 6 correspond to the embodiment of the present invention, and Experimental Examples 1, 2, 4, and 5 correspond to comparative examples.

Experimental Examples 1 to 3

A Cu—Zr alloy powder formed in a powdering step using a high-pressure Ar gas atomizing method was used and then sieved to a powder having a size of 106 μm or less. The contents of Zr were set to 1, 3, and 5 atomic percent and were used as an alloy powder in Experimental Examples 1 to 3, respectively. The grain size of the alloy powder was measured using a laser diffraction type grain size distribution measurement apparatus (SALD-3000J) manufactured by Shimadzu Corporation. The oxygen content of this powder was 0.100 percent by mass. SPS (spark plasma sintering) in a sintering step was performed using a spark plasma sintering apparatus (Model: SPS-3.2MK-IV) manufactured by SPS Syntex Corp. After 225 g of the powder was charged in a graphite-made die having a cavity of 50×50×10 mm, direct-current electricity at 3 to 4 kA was supplied under the conditions in which the temperature rise rate, the sintering temperature, the holding time, and the pressure were set to 0.4K/s, 1.173K (approximately 0.9Tm, Tm: melting point of alloy), 15 minutes, and 30 MPa, respectively, so that copper alloys (SPS materials) of Experimental Examples 1 to 3 were formed. The SPS material thus obtained was cut into a round bar having a diameter of 10 mm and a length of 50 mm, and wire drawing thereof was then performed. While intermediate annealing was repeatedly performed 6 times at 923K, cold wire drawing was performed from a diameter of 1 mm (wire drawing degree η of 4.6) to a minimum wire diameter of 0.037 mm (wire drawing degree η of 11.2) using swaging, a grooved roller, and a roller die in combination. The wires thus obtained were used as drawn copper alloy wires of Experimental Examples 1 to 3. In addition, in the experimental examples, the wire drawing degree η indicates $A_0/A$ ($A_0$: cross-sectional area before drawing, A: cross-sectional area after drawing), and the wire drawing was performed at a wire drawing degree η of 0, 4.6, 5.2, 7.0, 8.0, 10.5, and 11.2 in this order.

Experimental Examples 4 to 6

A copper alloy was formed by a copper die casting method. A Cu-4 at % Zr copper alloy, a Cu-4.5 at % Zr copper alloy, and a Cu-5.89 at % Zr copper alloy were used for Experimental Examples 4 to 6, respectively. First, a Cu—Zr binary system alloy formed of Zr in an amount corresponding to the above content and Cu as the balance was levitation dissolved in an Ar gas atmosphere. Next, die coating was performed on a pure copper die with a round, bar-shaped cavity having a diameter of 10 mm, and a molten alloy at approximately 1,200° C. was charged in the die to form a round bar-shaped ingot. By measurement using a micrometer, it was confirmed that the diameter of this ingot was 10 mm. Next, after the round bar-shaped ingot was cooled to room temperature, wire drawing of the ingot was performed through 20 to 40 dies having holes, the diameters of which were gradually decreased, to form a wire having a diameter of 1 mm after the wire drawing, and as a result, drawn wires of Experimental Examples 4 to 6 were obtained. In this step, the wire drawing rate was set to 20 m/min. By measurement using a micrometer, it was confirmed that the diameter of this copper alloy wire was 1 mm.

(Observation of Microstructure)

The observation of microstructure was performed using a scanning electron microscope (SEM), a scanning transmission electron microscope (STEM), and a nano-electron beam diffraction (NBD) method.

(XRD Measurement)

The identification of the compound phase was performed by an X-ray diffraction method using the Co-Kα line.

(Evaluation of Electrical Characteristics)

The electrical characteristics of the SPS materials and the drawn wires obtained in the experimental examples were measured at room temperature by probe type electrical conductivity measurement and four-terminal electrical resistance measurement at a length of 500 mm. The electrical conductivity was obtained in such a way that after the volume resistance of a copper alloy was measured in accordance with JISH0505, the ratio thereof to the resistance (1.7241 μΩ·cm) of annealed pure copper was calculated for conversion into the electrical conductivity (% IACS). The following equation was used for the conversion.

$$\text{Electrical conductivity } \gamma \text{ (\% IACS)} = 1.7241 \div \text{volume resistance } \rho \times 100$$

(Evaluation of Mechanical Characteristic)

In addition, the mechanical characteristic was measured using a precision universal tester AG-I (JIS B7721 class 0.5) manufactured by Shimadzu Corp. in accordance with JISZ2201. The tensile strength was obtained as a value obtained by dividing a maximum load by the initial cross-sectional area of a copper alloy wire.

(Evaluation of Characteristics of Cu—Zr Compound Phase)

Measurement of Young's modulus E and a hardness H by a nanoindentation method was performed on the Cu—Zr compound phase included in the copper alloy of Experimental Example 3. As a measurement apparatus, Nano Indenter XP/DCM manufactured by Agilent Technologies, Inc. was used, and as an indenter head and an indenter, XP and a diamond Berkovich type were used, respectively. In addition, as an analysis software, Test Works4 of Agilent Technologies, Inc. was used. As the measurement conditions, the measurement mode was set to CSM (continuous stiffness measurement); an excitation vibration frequency of 45 Hz, an excitation vibration amplitude of 2 nm, a strain rate of 0.05 $s^{-1}$, and an indentation depth of 1,000 nm were adopted; the number of measurement points N, the measurement point interval, and the measured temperature were set to 5, 5 μm, and 23° C., respectively; and as a standard sample, fused silica was used. After a cross-section polishing of a sample was performed by a cross section polisher (CP), and the sample thus prepared was fixed to a sample stage by heating to 100° C. for 30 seconds using a hot-melt type adhesive, the sample fixed to the sample stage was fitted to the measurement apparatus, and the Young's modulus E of the Cu—Zr compound phase and the hardness H thereof by a nanoindentation method were measured. In this measurement, the average values each obtained from five measurement results were regarded as the Young's modulus E and the hardness H by a nanoindentation method.

(Results and Discussion)

(Copper Alloy Powder)

Figure 2:
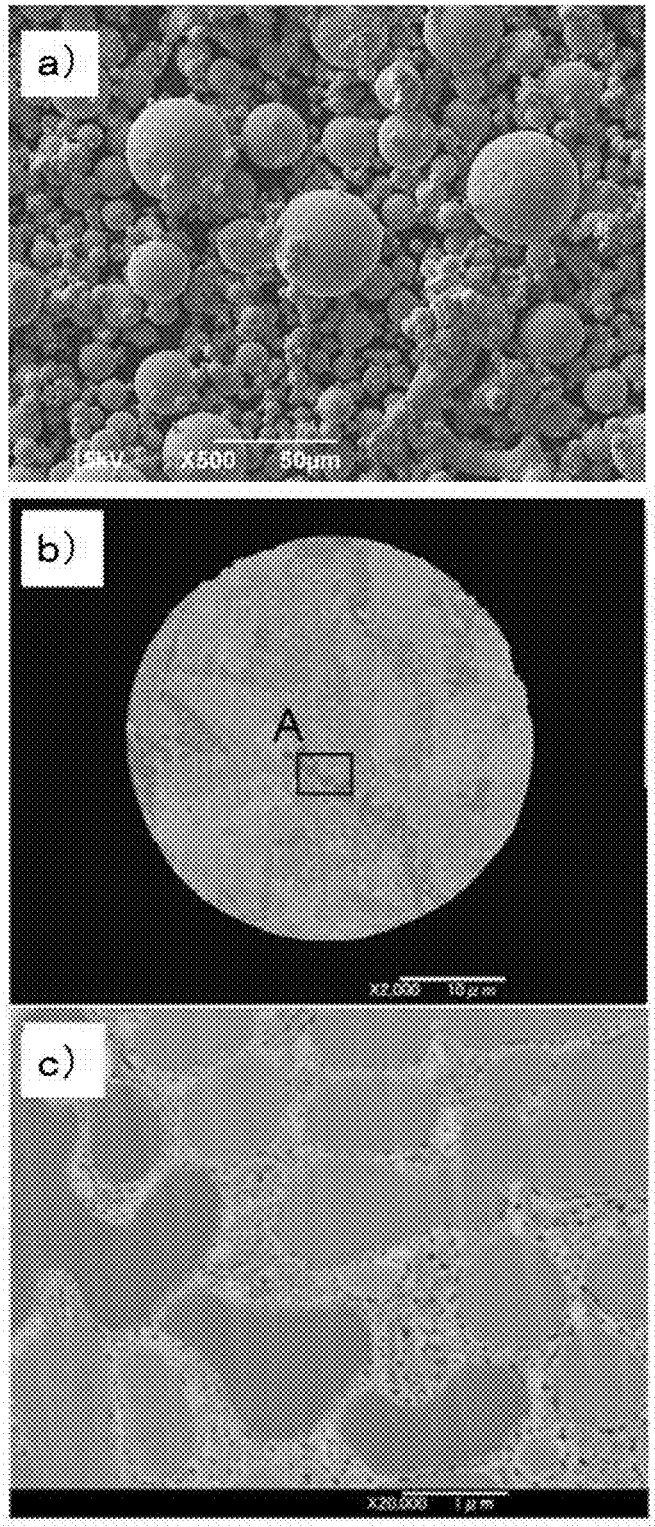
FIG. 2 shows cross-sectional SEM-BEI images of a Cu-5 at % Zr alloy powder.
Figure 3:
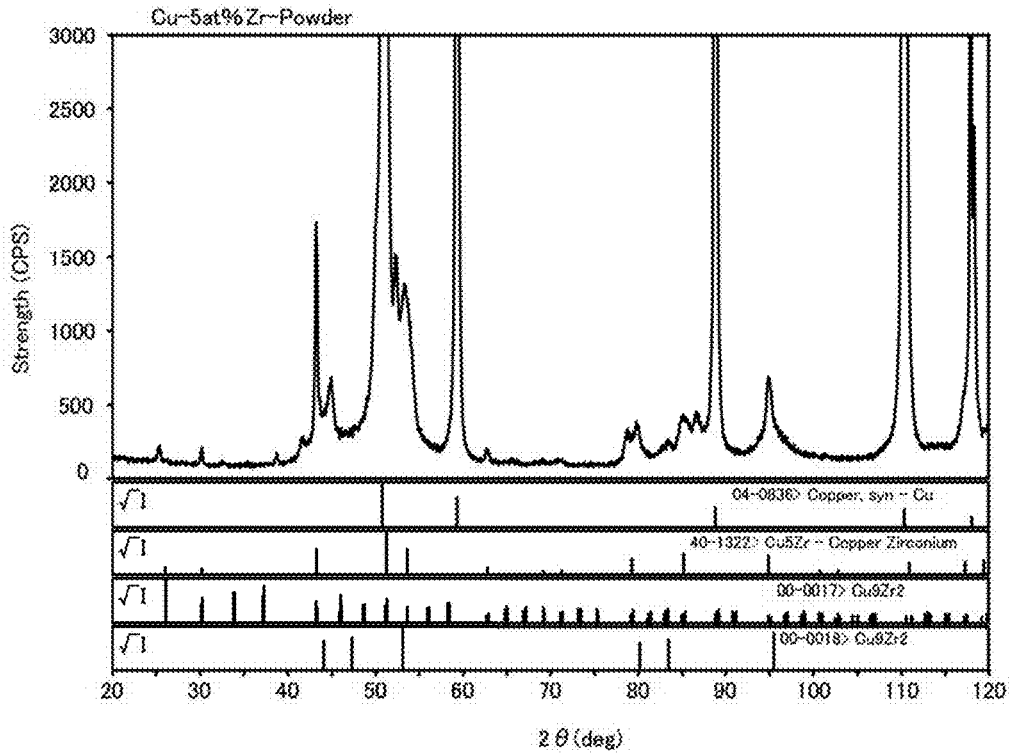
FIG. 3 shows an X-ray diffraction measurement result of the Cu-5 at % Zr alloy powder.

Cross-sectional SEM-BEX images of the Cu-5 at % Zr alloy powder formed by a high-pressure gas atomizing method (subsequently sieved to have a size of 106 μm or less) are shown in FIG. 2. The grain diameter was 36 μm. Dendrites supposed to be terminated during solidification by quenching were observed. Secondary DAS (dendrite Arm Spacing) was measured at arbitrary four points, and the average value thereof was 0.81 μm. This value is smaller by one digit than 2.7 μm of the Cu-4 at % Zr alloy formed by a copper die casting method, and the quenching effect can be observed. Although an aggregated state was observed to some extent in this powder, since a flake-like powder generated by collision with a spray chamber wall was removed, the amount thereof was small. The average grain diameters of the Cu-1 at % Zr, the Cu-3 at % Zr, and the Cu-5 at % Zr alloy powders were 26, 23, and 19 μm, respectively, and the standard deviations thereof were 0.25, 0.28, and 0.32 μm, respectively. The grain diameters of any one of the compositions showed an approximately lognormal distribution in a range of from 1 μm, which was the measurement limit, to 106 μm. Next, the result obtained by an X-ray diffraction method performed on the Cu-5 at % Zr alloy powder is shown in FIG. 3. X-ray diffraction peaks of an α-Cu phase functioning as a mother phase and a $Cu_5Zr$ compound phase in a eutectic phase were observed. In addition, besides the peaks described above, as the Cu—Zr-based compound phase, diffraction peaks which might be derived from $Cu_9Zr_2$ were slightly observed.

(SPS Material)

Figure 4:
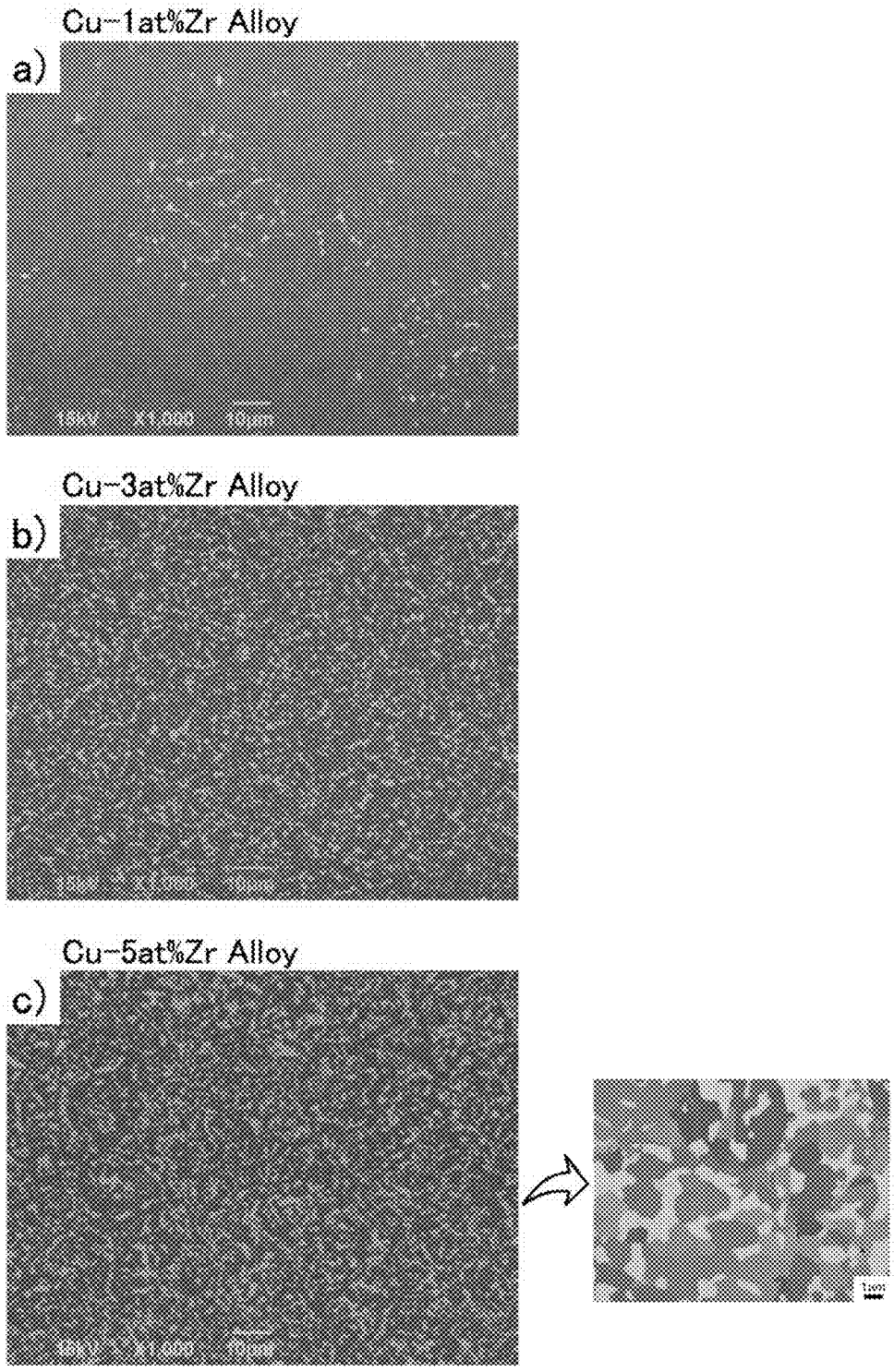
FIG. 4 shows SEM-BEI images of copper alloys each obtained by performing SPS on a Cu—Zr alloy powder.

FIG. 4 shows SEM-BEI images each showing a square plate of the Cu—Zr compound powder processed by SPS, FIG. 4(*a*) shows a Cu-1 at % Zr alloy, FIG. 4(*b*) shows a Cu-3 at % Zr alloy, and FIG. 4(*c*) shows a Cu-5 at % Zr alloy. The structures of the SPS materials shown in FIG. 4 were each a uniform and dense biphasic structure. This structure is different from the cast structure of the Cu—Zr compound formed by a copper die casting method disclosed in Patent Literatures 2 to 4. The biphasic structure as described above can be expected to show excellent workability in subsequent wire drawing or rolling. It can be said that this is the most advantage of the structure produced by solid phase bonding of quenched powder grains using SPS. In addition, when the individual phases of the SPS material of Experimental Example 3 were analyzed by SEM-EDX, Cu and a very small amount of Zr were detected in a gray mother phase; hence, it was found that the mother phase was an α-Cu phase. On the other hand, the amount of Zr analyzed in a white second phase was 16.9 atomic percent. The amount of Zr of the SPS material of Experimental Example 3 well corresponded to that of a $Cu_5Zr$ compound phase (Zr ratio: 16.7 atomic percent) in view of stoichiometry, and it was found that the second phase contained a $Cu_5Zr$ compound. That is, the $Cu_5Zr$ compound phase observed in the powder material was maintained after the SPS was performed. In addition, the specific gravities of the SPS materials of the Cu-1 at % Zr, the Cu-3 at % Zr, and the Cu-5 at % Zr alloys measured by an Archimedes method were 8.92, 8.85, and 8.79, respectively, and it was found that the SPS materials were each sufficiently densified.

Figure 5:
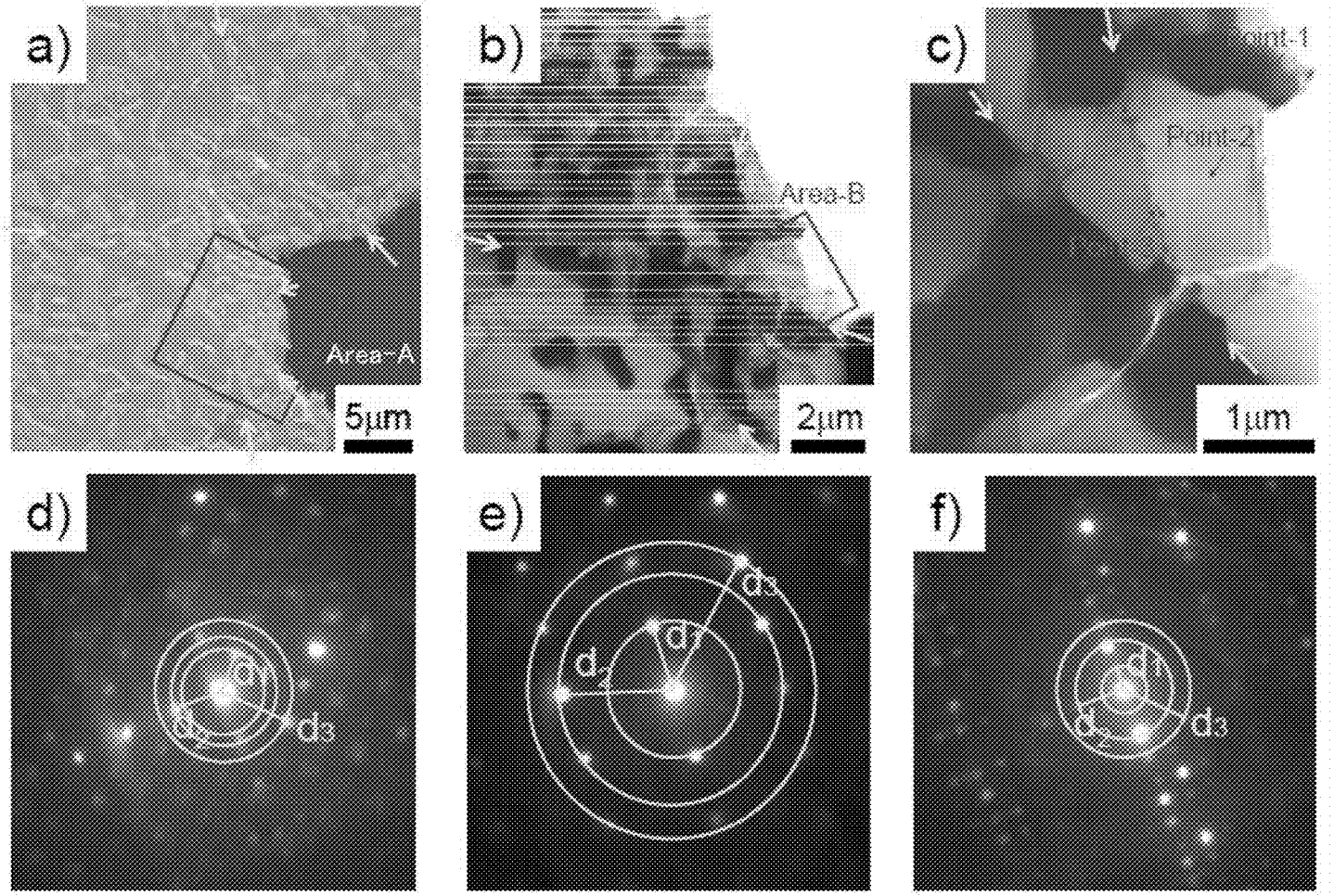
FIG. 5 shows FE-SEM images of a Cu-5 at % Zr alloy (SPS material of Experimental Example 3).

FIG. 5 shows FE-SEM images of the Cu-5 at % Zr alloy (SPS material of Experimental Example 3), FIG. 5(*a*) shows a FE-SEM image of a sample in the form of a thin film obtained by electrolytic polishing of the SPS material of Experimental Example 3 using a twin jet method. FIG. 5(*b*) shows a BF image of the Area-A of FIG. 5(*a*) obtained by STEM observation, and FIG. 5(*c*) shows a BF image of the Area-B of FIG. 5(*b*) obtained by STEM observation. In addition, FIG. 5(*d*) shows a NBD pattern of the Point-1 of FIG. 5(*c*), FIG. 5(*e*) shows a NBD pattern of the Point-2 of FIG. 5(*c*), and FIG. 5(*f*) shows a NBD pattern of the Point-3 of FIG. 5(*c*). In the electrolytic polishing using a twin jet method, as an electrolyte, a mixed solution containing 30 percent by volume of nitric acid and 70 percent by volume of methanol was used. According to this electrolytic polishing, since the etching rate of the Cu phase was fast, the biphasic structure could be clearly observed. On the curved line sandwiched by the arrows in the drawing, traces of powder grain boundaries were observed, and along those boundaries, fine grains, which might be oxides, were dispersed. In the other viewing fields, a twin crystal running from the grain boundary as described above into the Cu phase was observed, and the presence of voids having a size of 50 to 100 nm was also confirmed although the number thereof was very small. In the α-Cu phase of FIG. 5(*b*), a mosaic-like phase including a black $Cu_5Zr$ compound is dispersed. Dislocation was only slightly observed in the Cu phase, and the structure which was considered to be enlarged by sufficient recovery or re-crystallization was observed. In FIG. 5(*c*), along the powder grain boundary, oxide grains having a size of approximately 30 to 80 nm were dispersed.

The results of EDX point analysis of the front ends of the arrows of the Point-1 to the Point-3 are shown in Table 1. It was estimated that the Point 1 indicated the $Cu_5Zr$ compound phase. In addition, the Point-2 indicated the Cu phase. According to the measurement result of this Point-2, although detection could not be performed due to the problem of analysis accuracy, it was estimated that approximately 0.3 atomic percent of Zr in an oversaturated state was contained. In addition, from the analytical result of a bar-shaped oxide of the Point-3, it was found that this oxide was a composite oxide containing Cu and Zr. As shown in FIGS. 5(*d*) to (*f*), different diffraction spots represented by d1, d2, and d3 were obtained, and the lattice spacings obtained therefrom are shown in Table 2. In Table 2, for comparison purposes, there are also shown the lattice spacings of a $Cu_5Zr$ compound, a $Cu_9Zr_2$ compound, and a $Cu_8Zr_3$ compound, which were observed in a Cu-0.5 at % Zr to a Cu-5at % Zr alloy wire each having a hypoeutectic composition, and the lattice spacings of Cu and oxides in the form of $Cu_8O_7$, $Cu_4O_3$, and $Cu_2O_2$, the above spacings each being obtained by calculation on the specific crystal plane. The NBD pattern of the Point-1 approximately corresponded to the lattice parameters of the $Cu_5zr$ compound. The NBD pattern of the Point-2 approximately corresponded to the lattice parameters of Cu. On the other hand, the NBD pattern of the Point-3 corresponded to the lattice parameters of no one of the oxide compounds. Hence, at the Point-3, it might be considered that the fine grain on the powder grain boundary was a composite oxide containing a Zr atom. From the results shown in FIGS. 5(*a*) to (*c*) and Table 2, it was found that the Point-1 indicated the $Cu_5Zr$ compound monophase, the Point-2 indicated the α-Cu phase, and the grain of the Point-3 indicated an oxide containing Cu and Zr.

TABLE 1

| Point | O (at %) | Cu (at %) | Zr (at %) |
|---|---|---|---|
| 1 | — | 83.5 | 16.5 |
| 2 | — | 100.0 | — |
| 3 | 34.3 | 55.3 | 10.4 |

TABLE 2

| Point-1 | | Point-2 | | Point-3 | |
|---|---|---|---|---|---|
| Symbol | Distance/ nm | Symbol | Distance/ nm | Symbol | Distance/ nm |
| $d_1$ | 0.3431 | $d_1$ | 0.1809 | $d_1$ | 0.5686 |
| $d_2$ | 0.2427 | $d_2$ | 0.1087 | $d_2$ | 0.2653 |
| $d_3$ | 0.1716 | $d_3$ | 0.0829 | $d_3$ | 0.1895 |

| Phase | System of symmetry | Lattice plane | Lattice parameter/ nm |
|---|---|---|---|
| $Cu_5Zr$ | cubic | (200) | 0.3435 |
| | | (220) | 0.2429 |
| | | (400) | 0.1717 |
| $Cu_9Zr_2$ | tetragonal | (200) | 0.3428 |
| | | (220) | 0.2424 |
| | | (400) | 0.1714 |
| $Cu_8Zr_3$ | orthorhombic | (121) | 0.3403 |
| | | (311) | 0.2422 |
| | | (215) | 0.1740 |
| Cu | cubic | (200) | 0.1808 |
| | | (311) | 0.1090 |
| | | (331) | 0.0829 |
| $Cu_8O_7$ | tetragonal | (100) | 0.5817 |
| | | (210) | 0.2601 |
| | | (222) | 0.1899 |
| $Cu_4O_3$ | tetragonal | (101) | 0.5010 |
| | | (211) | 0.2517 |
| | | (301) | 0.1904 |
| $Cu_2O$ | cubic | (100) | 0.4217 |
| | | (111) | 0.2435 |
| | | (210) | 0.1886 |

As described above, the $Cu_5Zr$ compound observed in the SPS material was a monophase and was different from a eutectic phase ($Cu+Cu_9Zr_2$) of the sample formed by a die casting method. That is, the dendrite structure of the α-Cu phase and the eutectic phase ($Cu+Cu_5Zr$) observed in the powder material was changed by SPS into a biphasic structure of the α-Cu phase and the $Cu_5Zr$ compound monophase. Although the mechanism working in this case has not been clearly understood, for example, there may be some probability that for example, while the temperature is increased to 1,173K or this temperature is maintained for 15 minutes by a SPS method, by pressure application and giant electrical energy generated by a large current application, rapid diffusion and movement of Cu atoms occur, and the recovery, the dynamic and static re-crystallization, and the secondary growth of the Cu phase are promoted, so that the biphasic separation occurs. In addition, it may also foe believed that although the oxide film on the surface of the powder grain is reduced in the graphite die by SPS and is fractured into pieces, a part of the film which is not reduced even by an alloy containing active Zr remains as oxide grains in the SPS material.

Figure 6:
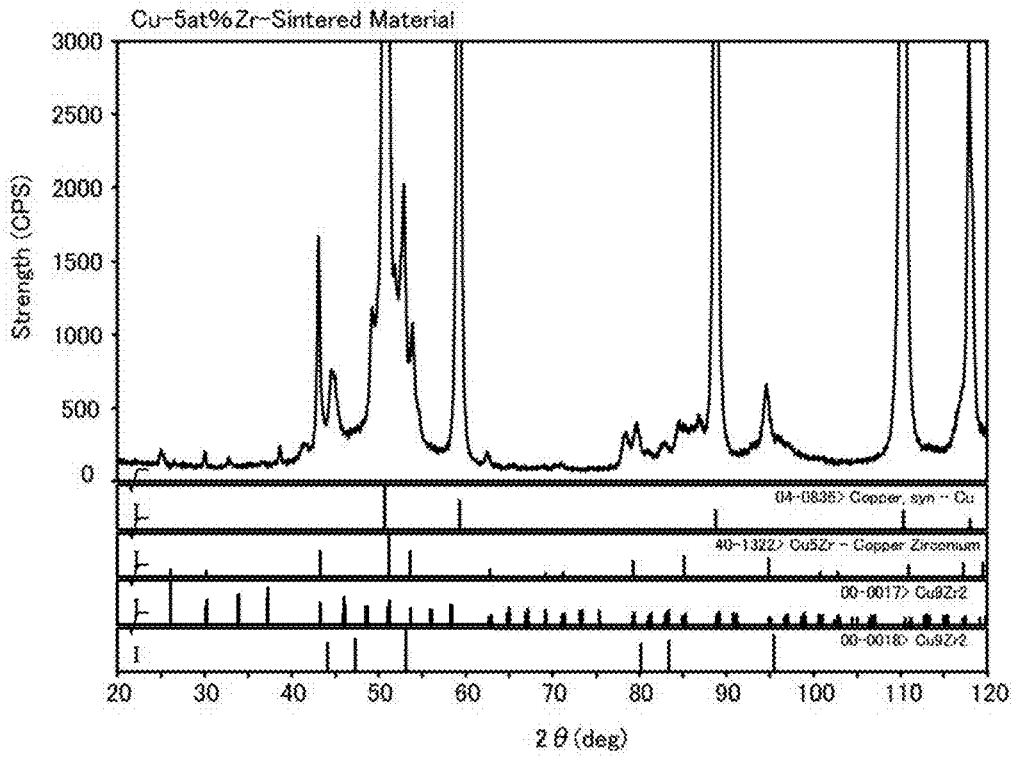
FIG. 6 shows an X-ray diffraction measurement result of the Cu-5 at % Zr alloy (SPS material of Experimental Example 3).

FIG. 6 shows X-ray diffraction measurement results of the Cu-5 at % Zr alloy (SPS material of Experimental Example 3). This SPS material included a Cu phase and a $Cu_5Zr$ compound phase as in the powder material, and the positions of the individual diffraction peaks were slightly shifted to a low angle side with respect to those of the powder material. That is, it was shown that the lattice parameter of the SPS material was larger than that of the powder material. The reason for this was believed that the lattice strain generated in the powder material by quenching of a high-pressure gas atomizing method was reduced by holding at a high temperature during the SPS.

Figure 7:
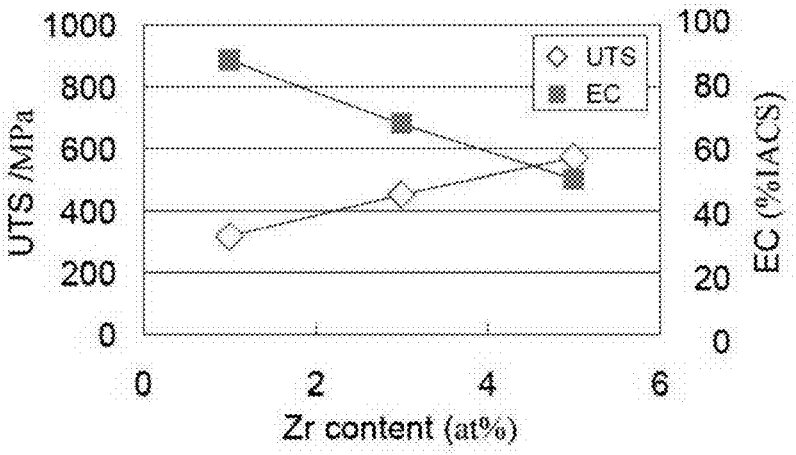
FIG. 7 shows measurement results of the tensile strength and the electrical conductivity of a SPS material of a Cu—Zr alloy.

FIG. 7 shows the measurement results of the tensile strength (UTS) and the electrical conductivity (EC) of a sample of the SPS material of each of the Cu-1 at % Zr, the Cu-3 at % Zr, and the Cu-5 at % Zr alloys, the sample being obtained from a cut surface thereof in a direction parallel to the pressure application direction. With respect to the Zr amount, the strength was increased as the content of Zr was increased, and the electrical conductivity was decreased as the content of Zr was increased. For example, the electrical conductivity of the SPS material was higher than an electrical conductivity 28% (IACS) of an as-cast material of the Cu-4 at % Zr alloy formed by a copper die casting method. The reason for this was believed that Cu phases in the powder grains were bonded to each other by SPS so as to form a dense network structure.

The measurement results of the Young's modulus E and the hardness H by a nanoindentation method of a microstructure of the Cu—Zr compound phase included in the copper alloy are shown in Table 3. As shown in Table 3, the Young's modulus E of the Cu—Zr compound phase was high, such as 159.5 GPa, and the hardness H by a nanoindentation method was also high, such as 6.336 GPa. In addition, when this hardness H was converted into Vickers hardness Hv by the conversion equation; Hv=0.0924×H based on ISO 141577-1 Metallic Materials-Instrumented indentation test for hardness and materials parameters-Part 1: Test Methods, 2002, the hardness was approximately 585. It was inferred that by the presence of this Cu—Zr compound phase, the mechanical strength could be increased. In addition, although a Cu-14.2 at % Zr alloy was also measured in a manner similar to that described above, the Young's modulus E and the hardness H of the Cu—Zr compound phase were further increased to 176.8 GPa and 9.216 GPa, respectively.

TABLE 3

| | Composition | Object to be Measured | Young's Modulus E GPa | Hardness H GPa |
|---|---|---|---|---|
| Experimental Example 3 | Cu-5 at % Zr Alloy | Cu—Zr Compound | 159.5 | 6.336 |

(Drawn Copper Alloy Wire)

Figure 8:
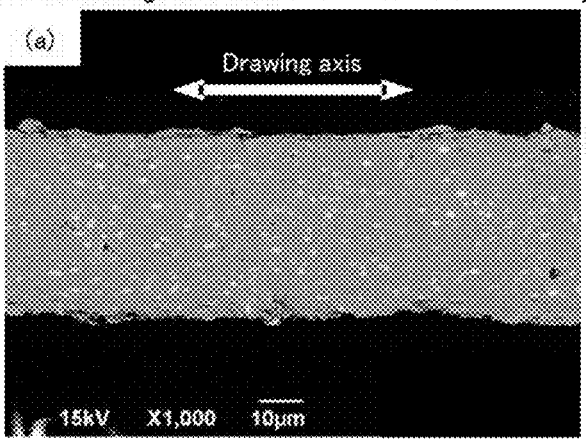
FIG. 8 shows SEM-BEI images of drawn copper alloy wires at a wire drawing degree η of 4.6.
Figure 8:
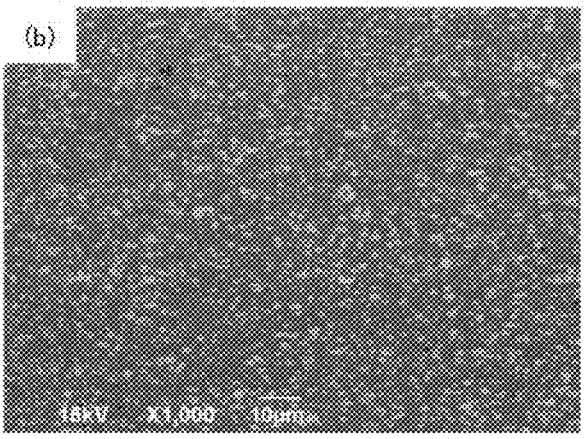
Figure 8:
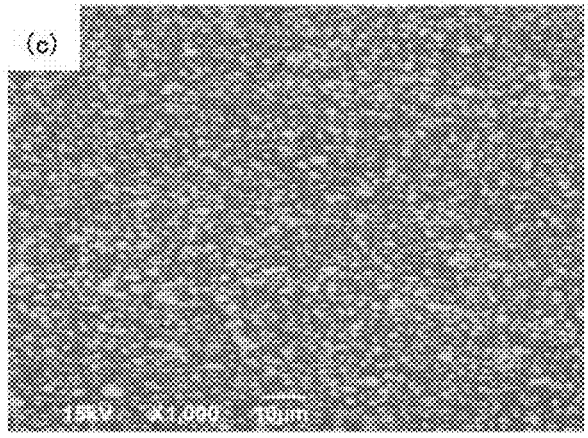
Figure 9:
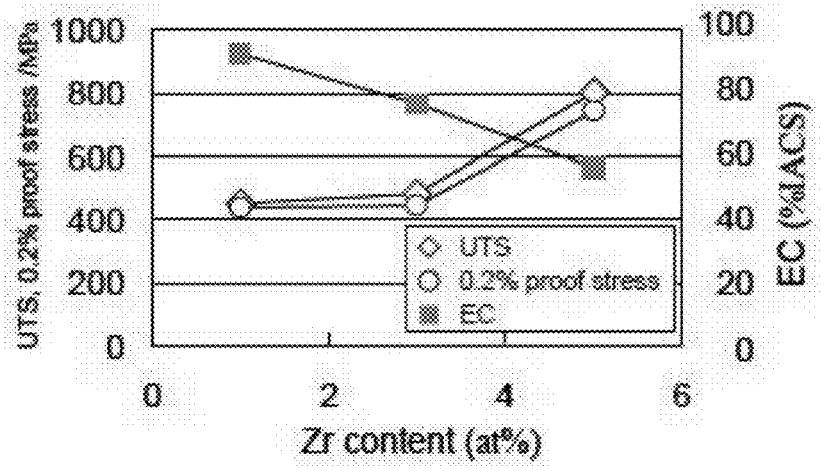
FIG. 9 shows measurement results of the tensile strength, a 0.2% proof stress, and the electrical conductivity of a drawn Cu-5 At % Zr alloy wire at a wire drawing degree η of 4.6.

The SPS materials of the Cu-1 at % Zr, the Cu-3 at % Zr, and the Cu-5 at % Zr alloys, each of which had a diameter of 10 mm, could be dram at a wire drawing degree η of 4.6 to a wire having a diameter of 1 mm without breakage. Although a copper alloy containing 5 atomic percent of Zr and formed by a copper die casting method was not likely to be processed by wire drawing, wire drawing of the SPS material could be performed. In addition, breakage occurred in the copper alloy (Experimental Example 6) containing 5.89 atomic percent of Zr and formed by a copper die casting method described above, and wire drawing could not be performed. FIG. 8 shows SEM-BEI images of drawn copper alloy wires at a wire drawing degree η of 4.6. As shown in FIG. 8, the structure was observed in which the Cu phase and the $Cu_5Zr$ compound phase were each elongated in a drawing axis (D.A.) direction. In addition, dispersed black points in FIG. 8 were remnants of a polishing agent, and for example, the generation of voids was not observed. FIG. 9 shows the measurement results of the tensile strength, the 0.25 proof stress, and the electrical conductivity of the drawn Cu-5 at % Zr copper alloy wire at a wire drawing degree η of 4.6. The tensile strength and the 0.2% proof stress each indicate the average value obtained from three measurement results. The tensile strength and the 0.2% proof stress were each higher than those of the SPS material. The reason for this is believed that the $Cu_5Zr$ compound itself is deformed and divided by shearing deformation, and the biphasic structure of the SPS material is changed into a denser biphasic dispersed structure. On the other hand, compared to the drawn Cu-4 at % Zr copper alloy wire formed by a copper die casting method and drawn at approximately the same wire drawing degree as described above, the values of the drawn Cu-5 at%: Zr copper alloy wire were low. The reason for this is believed as follows. That is, although the former wire had a developed layered structure by shearing deformation of the Cu phase and the eutectic phase, in the structure of the material of the present invention, the $Cu_5Zr$ compound monophase was forced to be shearing deformed, and the deformability thereof was different from that of the former wire, so that the development of the layered structure was delayed. Furthermore, the electrical conductivity of the drawn wire was higher than that of the SPS material. The reason for this was believed that since the network-like Cu phase observed in the SPS material was elongated by shearing deformation, the contact length therebetween was increased, and the electrical conductivity was increased. As compared to the electrical conductivity of the drawn Cu-4 at % Zr copper alloy wire formed by a copper die casting method and drawn at approximately the same drawing degree as described above, the electrical conductivity of the material was high by approximately 10% IACS. As described above, it was found that a wire having a high electrical conductivity could be obtained from the drawn Cu-1 at % Zr, Cu-3 at % Zr, and Cu-5 at % Zr copper alloy wires, each of which was formed from the SPS material by wire drawing, as compared to that obtained by wire drawing of a copper die casting material. The reason for this was that, although the same alloy composition was used, the biphasic structure including the network-like α-Cu phase and the mosaic-like $Cu_5Zr$ compound monophase dispersed therein was formed by a SPS method, and it was believed that this excellent electrical conductivity was the significant advantage of this wire. In addition, although wire drawing was also tried on a SPS material of the Cu-14.2 at % Zr alloy, the workability thereof was seriously low, and the wire drawing could not be performed. The reason for this was inferred that for example, when the content of Zr was more than 8.6 atomic percent (see the binary system phase diagram of FIG. 1), the structure was formed in which a Cu—Zr compound was present in a eutectic phase (main phase) of Cu and a Cu—Zr compound, and hence the workability, such as wire drawing or rolling, was seriously degraded.

Figure 10:
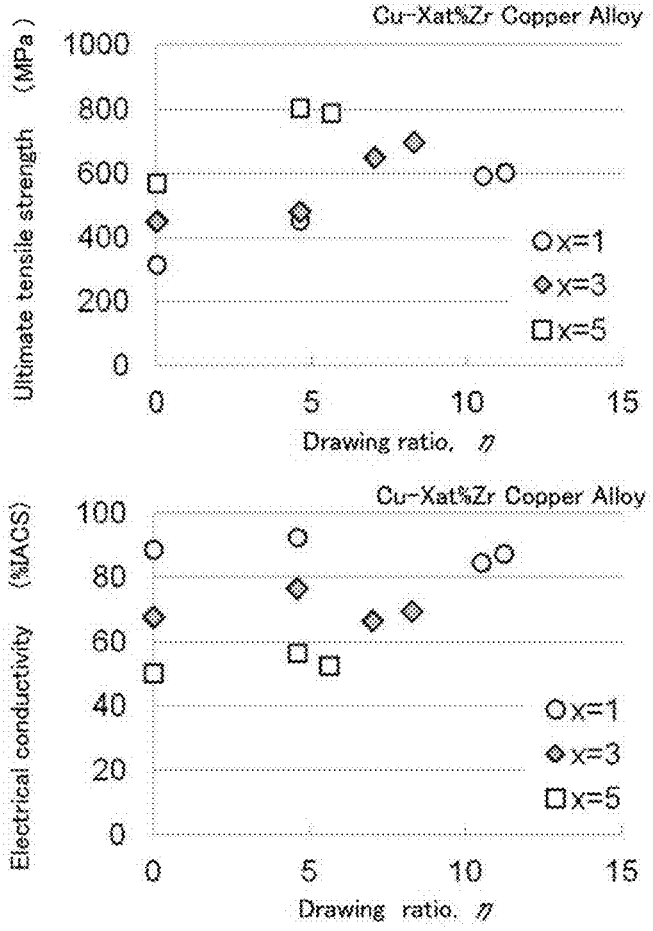
FIG. 10 shows measurement results of the tensile strength and the electrical conductivity (EC) of a drawn Cu—Zr alloy wire with respect to the wire drawing degree η and the Zr content X.

FIG. 10 shows the measurement results of the tensile strength (UTS) and the electrical conductivity (EC) of each of the draw Cu-1 at % Zr, the drawn Cu-3 at % Zr, and the drawn Cu-5 at % Zr copper alloy wires with respect to the wire drawing degree η and a Zr content X. As shown in FIG. 10, it was found that according to the drawn copper alloy wires of Experimental Examples 1 to 3, as the wire drawing degree η was increased, the tensile strength tended to increase. In addition, it was found that according to the drawn copper alloy wires of Experimental Examples 1 to 3, as the Zr content X was increased, the tensile strength tended to increase. In particular, in the drawn copper alloy wire of Experimental Example 3, the above tendency was significant. In addition, it was also found that according to the drawn copper alloy wire of Experimental Example 3, as the wire drawing degree η was increased, the electrical conductivity tended to increase. That is, it was found that when the wire drawing degree η of the drawn Cu-5 at % Zr copper alloy wire, which had a higher Zr content, was increased, besides the improvement in workability, the electrical conductivity and the tensile strength could also be further increased.

The structure and the electrical and mechanical characteristics of drawn wires obtained by wire drawing of the Cu-1 at % Zr, the Cu-3 at % Zr, and the Cu-5 at % Zr copper alloys, each of which had a hypoeutectic composition and was formed by a SPS method, were investigated, and the following results were obtained. The average grain diameters of the Cu-1 at % Zr, the Cu-3 at % Zr, and the Cu-5 at % Zr copper alloy powders, each of which had a hypoeutectic phase and was formed by a high-pressure gas atomizing method, were 19 to 26 μ. In the Cu-5 at % Zr copper alloy powder, a dendrite structure including a Cu phase and a eutectic phase was formed, and the secondary DAS was 0.81 μm in average. This powder was changed into a SPS material having a dense biphasic structure formed of a recovered or a re-crystallized network-like Cu phase and a mosaic-like $Cu_5Zr$ compound monophase dispersed therein. The amount of the $Cu_5Zr$ compound phase was increased with the increase in Zr content. To the increase in Zr addition amount, the tensile strength of the SPS material was proportional, and the electrical conductivity was inversely proportional. Drawn wires having a diameter of 1 mm obtained from the Cu-1 at. % Zr, the Cu-3 at % Zr, and the Cu-5 at % Zr copper alloys (SPS materials) by wire drawing each showed a dense biphasic structure formed of elongated Cu phase and $Cu_5Zr$ compound phase. The strength and the electrical conductivity of those wires were higher than those of the SPS materials. In particular, even in Experimental Example 3 in which the content of Zr was high (Cu-5 at. % Zr copper alloy), wire drawing could be performed. When this dense biphasic structure formed of a recovered or re-crystallized network-like Cu phase and a mosaic-like $Cu_5Zr$ compound monophase dispersed therein could be obtained, it was inferred that wire drawing and rolling could be performed even on a copper alloy having a higher Zr content, such as a Cu-8 at % Zr copper alloy, which was formed by a related copper die casting method or the like and which was more difficult to be processed by wire drawing and rolling.

This application claims the benefit of priority from Japanese Patent Application No. 2012-241712, filed on Nov. 1, 2012, the contents of which are hereby incorporated by reference herein in its entirety.

INDUSTRIAL APPLICABILITY

The present invention can be applied to technical fields relating to manufacturing of copper alloys.

What is claimed is:

1. A copper alloy which contains 5.00 to 8.00 atomic percent of Zr and which includes Cu and a Cu—Zr compound, wherein two phases of the Cu and the Cu—Zr compound form a mosaic structure which includes no eutectic phase and in which when viewed in cross section, crystals having a size of 10 μm or less are dispersed.

2. The copper alloy according to claim 1, wherein the Cu—Zr compound includes at least one of $Cu_5Zr$, $Cu_9Zr_2$, and $Cu_8Zr_3$.

3. The copper alloy according to claim 1, being formed from a Cu—Zr binary system alloy powder having a hypoeutectic composition by spark plasma sintering.

4. The copper alloy according to claim 3, wherein after spark plasma sintering is performed on a Cu—Zr binary system alloy powder, wire drawing is performed, so that the mosaic structure elongated in the drawing direction is formed.

5. The copper alloy according to claim 3, wherein after spark plasma sintering is performed on a Cu—Zr binary system alloy powder, rolling is performed, so that the mosaic structure flattened in the rolling direction is formed.

6. A method for manufacturing a copper alloy including Cu and a Cu—Zr compound, the method comprising: a sintering step of performing spark plasma sintering on a Cu—Zr binary system alloy powder at a temperature of 0.9 Tm (° C.) or less, where Tm (° C.) is the melting point of the alloy powder, by supply of direct-current pulse electricity, the Cu—Zr binary system alloy powder having an average grain diameter of 30 μm or less and a hypoeutectic composition which contains 5.00 to 8.00 atomic percent of Zr, wherein two phases of the Cu and the Cu—Zr compound form a mosaic structure which includes no eutectic phase and in which when viewed in cross section, crystals having a size of 10 μm or less are dispersed.

7. The method for manufacturing a copper alloy according to claim 6, further comprising, before the sintering step, a powdering step of forming the Cu—Zr binary system alloy powder having an average grain diameter of 30 μm or less by performing a high-pressure atomizing method on a Cu—Zr binary system alloy having the hypoeutectic composition.

8. The method for manufacturing a copper alloy according to claim 6, further comprising, after the sintering step, a wire drawing step of performing wire drawing on a spark plasma sintered copper alloy.

9. The method for manufacturing a copper alloy according to claim 8, wherein in the wire drawing step, when a wire drawing degree η is represented by $A_0/A$ ($A_0$: cross-sectional area before drawing, A: cross-sectional area after drawing), the wire drawing is performed at a wire drawing degree η of 3.0 or more.

10. The method for manufacturing a copper alloy according to claim 6, further comprising, after the sintering step, a rolling step of performing rolling on a spark plasma sintered copper alloy at 500° C. or less.

* * * * *